US008408746B1

(12) United States Patent
Lauer

(10) Patent No.: US 8,408,746 B1
(45) Date of Patent: Apr. 2, 2013

(54) ARTIFICIAL CANDLES WITH GLOWING CANOPIES THAT FLUTTER

(76) Inventor: Mark Lauer, Pleasanton, CA (US)

( * ) Notice: Subject to any disclaimer, the term of this patent is extended or adjusted under 35 U.S.C. 154(b) by 469 days.

(21) Appl. No.: 12/615,978

(22) Filed: Nov. 10, 2009

Related U.S. Application Data

(60) Provisional application No. 61/115,918, filed on Nov. 18, 2008.

(51) Int. Cl.
*F21V 17/02* (2006.01)

(52) U.S. Cl. ..... 362/284; 362/271; 362/324; 362/800

(58) Field of Classification Search ..... 362/269–275, 362/284, 282, 324
See application file for complete search history.

(56) References Cited

U.S. PATENT DOCUMENTS

| | | | | |
|---|---|---|---|---|
| 2,435,811 | A | 2/1948 | Waters | |
| 3,681,588 | A * | 8/1972 | Lee | 362/569 |
| 4,328,534 | A * | 5/1982 | Abe | 362/295 |
| 5,119,281 | A | 6/1992 | Akman | |
| 5,843,329 | A | 12/1998 | Deetz | |
| 6,454,425 | B1 | 9/2002 | Lin | |
| 6,461,011 | B1 * | 10/2002 | Harrison | 362/96 |
| 6,966,665 | B2 | 11/2005 | Limburg et al. | |
| 7,036,958 | B2 | 5/2006 | Hayne et al. | |
| 7,159,994 | B2 | 1/2007 | Schnuckle et al. | |
| 7,350,720 | B2 * | 4/2008 | Jaworski et al. | 239/55 |
| 7,850,346 | B1 * | 12/2010 | Lauer | 362/362 |
| 8,235,558 | B1 * | 8/2012 | Lauer | 362/362 |
| 2001/0033488 | A1 * | 10/2001 | Chliwnyj et al. | 362/231 |
| 2003/0081420 | A1 * | 5/2003 | Jensen et al. | 362/392 |
| 2005/0212397 | A1 * | 9/2005 | Murazaki et al. | 313/487 |
| 2006/0034100 | A1 | 2/2006 | Schnuckle et al. | |
| 2006/0146544 | A1 | 7/2006 | Leung | |
| 2008/0151571 | A1 * | 6/2008 | Chen | 362/569 |

OTHER PUBLICATIONS

Internet pages entitled, "Flickering Yellow Flame LED Candle," 3 pages, printed Dec. 13, 2006.
Internet pages entitled, "Battery Operated Tealight Candles S/12," 1 page, printed Dec. 13, 2006.
Internet pages of Lamps Plus, Inc. entitled, "Traditional Eight Light Polished Brass Chandeliers," 1 page, printed Dec. 8, 2006.
Internet pages of LEDtronics entitle, "LEDtronics Products in the News," 2 pages, printed Dec. 20, 2006.
Internet pages of LEDtronics, Inc. entitled, "Standard Intensity Snap-In Panel Mount LEDs," 2 pages, printed Jul. 15, 2006.
Dialight Corporation Specification entitled, "Dialight 521 Series 2mm Discrete LED Diffused," 1 page.
LEDtronics, Inc. Specification entitled, "LD120CWXXK (3MM)," 1 page.
Internet pages of Luxa entitled, "Luxa Flame Lighting," 3 pages, printed Jul. 22, 2006.
Internet pages of NexTag, Inc. entitled, "American Dj Z-Torch/Silk Replacement Flame," 2 pages, printed Jul. 22, 2006.
Internet pages entitled, "Wicked Beernut Home—Halloween Home—Haunt Lighting Home," 8 pages, printed Jul. 22, 2006.
Internet pages of 10 out of 10 Productions Limited entitled, "10 out of 10 Productions Limited Silk Flame Effects," 10 pages, printed Jul. 22, 2006.

* cited by examiner

*Primary Examiner* — Jong-Suk (James) Lee
*Assistant Examiner* — Leah S Macchiarolo
(74) *Attorney, Agent, or Firm* — Mark Lauer

(57) ABSTRACT

An artificial candle has a flexible glowing canopy that can flutter like a candle flame, and the canopy may surround a "wick" that can be seen through the canopy to glow. Such a diaphanous canopy can be actuated by a solenoid, piezoelectric actuator or other mechanism, which can be provided adjacent to the canopy. Light can emanate from at least one light emitting diode (LED), and the canopy can include fluorescent material that absorbs and reradiates some of the light from the LED(s). The wick and the canopy can be coupled to a shaft that simulates a wax candle body. A standard threaded fitting can be provided so that the artificial candle can thread into a socket to replace an incandescent light bulb.

28 Claims, 3 Drawing Sheets

ARTIFICIAL CANDLES WITH GLOWING CANOPIES THAT FLUTTER

CROSS-REFERENCE TO RELATED APPLICATION

This application claims the benefit under 35 U.S.C. §119 of provisional application No. 61/115,918, filed Nov. 18, 2008, which is incorporated herein by reference.

BACKGROUND

The present application relates to lighting and illumination devices and systems.

Although beautiful, candles have been virtually replaced by the invention of electrically powered light bulbs, which have many advantages but typically are not as aesthetically pleasing. There has been a longstanding need to create an electrically powered light bulb that has the beauty of a candle. For example, beautiful chandeliers with intricate metal frames and multiple, dangling crystalline jewels are typically adorned with light bulbs that at best look artificial. To fix this problem, light bulbs have been fashioned with a pointed end or spiral shape, have been illuminated with light that varies in intensity, by changing input voltage or current or being shuttered, all in an attempt to look like a candle flame. Despite myriad patent applications, issued patents and multiple products that attempt to simulate candle flames, a need still exists to have an electrically powered light that is more beautiful, and a need still exists to have such a light that simulates the appearance of a candle or other flame.

SUMMARY

In one embodiment, an illumination device is disclosed comprising: a light source including a light emitting diode (LED) that emits electromagnetic radiation; a canopy that substantially encircles the light source and simulates a candle flame when irradiated by the light source; and an actuator including a rod that is operably coupled to an upper portion of the canopy to move the canopy.

In one embodiment, a method for illumination is disclosed comprising: providing a flexible canopy that is operably coupled to a light source; emitting electromagnetic radiation from the light source such that the radiation impinges upon an interior surface of the canopy; transmitting, by the canopy, visible light in response to receiving the radiation from the light source; and moving the canopy with a rod that contacts an upper portion of the canopy during the transmitting.

This brief summary does not purport to define the invention.

DETAILED DESCRIPTION

Figure 1:
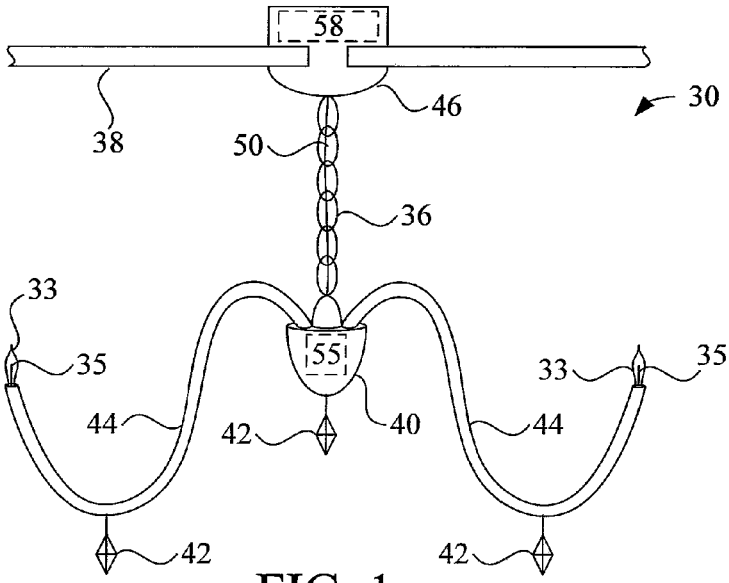
FIG. 1 is a side and schematic view of an embodiment of an illumination device such as a chandelier.

FIG. 1 shows an embodiment of an illumination device 30 such as a chandelier. The chandelier 30 has a plurality of glowing flame-shaped canopies 33 that transmit visible light while moving so as to simulate candle flames. Operably coupled to each flame-shaped canopy 33 is a light source 35, which emits electromagnetic radiation such as visible, infrared or ultraviolet light. In one embodiment the light source 35 is a light-emitting diode (LED) or a plurality of LEDs, and the canopy 33 is a veil or shroud that is translucent and may transmit, diffuse, reflect and/or refract the radiation from the LED(s). In one embodiment the canopy 33 is imbued with fluorescent or other light emitting material that glows when subjected to electromagnetic radiation from a light source 35 disposed within the canopy 33. In one embodiment the canopy 33 is flexible and may change shape to simulate the flickering shape of a candle flame. The light source 35 such as LEDs may be disposed near a tip of a small pole that simulates a candle wick, or along an upper section of such a pole, such as an upper half of the pole, or in a recessed base section, in each case shining light on the canopy 33 to cause the canopy to simulate a candle flame. The canopy 33 may also be substantially opaque but include fluorescent or phosphorescent material that absorbs at least some of the radiation from the light source 35 and thereupon emits visible light.

The chandelier 30 hangs by a chain 36 from a wall 38 such as a ceiling of a room. The chandelier 30 has a centrally located body 40 to which a pair of arms or tubes 44 are attached, each tube holding a light source 35 and canopy 33. The chandelier 30 also has a plurality of crystals 42, which hang from the tubes 44 and body 40. The chandelier 30 has a mounting apparatus 46 that attaches the chandelier to the ceiling 38, and a conduit 50 that runs between the mounting apparatus 46 and the body 40 to carry electricity. The chandelier 30 shown in FIG. 1 is drawn simplistically to facilitate understanding of the invention, but of course may have many more light sources 35 and canopies 33, arms or tubes 44, crystals 42 and body 40 sections.

The illumination device 30 contains at least one actuator that is operably coupled to the canopy 33 to move the canopy relative to the light source 35, so that the canopy changes shape or position. As one example, the actuator 35 can include a solenoid winding that is aligned with or part of the small pole that simulates a candle wick, with a magnetized rod that extends near an axis of the winding to move the canopy 35 in response to current in the winding. An electrical lead can be disposed within each tube 44 to provide electrical power to light source 35 and solenoid. In another example, the actuator can be a piezoelectric device that changes shape in response to a change in voltage, to move a rod similar to rod 112. A lever arm or other mechanism can be coupled between the piezoelectric device and the rod to magnify the motion of the piezoelectric device at the rod.

A power supply such as 110 volt (V) or 220 V alternating current (AC) can be disposed within the mounting apparatus 46 and in electrical communication with each shroud 33 via its respective tube 44. Typical LEDs that may be employed as light sources, however, may be designed to use a few volts DC instead of over one-hundred volts of AC, and a solenoid would also typically be rendered ineffective by such alternating current. Thus, the electrical power may be converted from AC to direct current (DC) of a voltage and current appropriate for light source 35 by a converter 55. In an alternative embodiment that may be more appropriate for an individual illumination device that is not part of a fixture (e.g., a device simulating a hand held candle), the power supply can comprise one or more batteries that provide DC power. In some embodiments disclosed below, electrical power need not be converted from household AC voltage levels to much lower DC voltage required for an LED.

Figure 2:
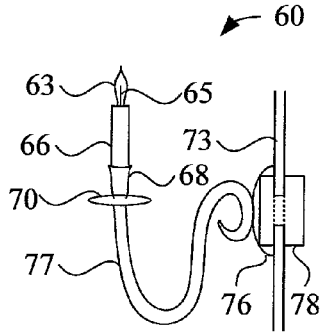
FIG. 2 is a side and schematic view of an embodiment of an illumination device such as a wall sconce.

FIG. 2 shows an embodiment of an illumination device 60 such as a wall sconce. The wall sconce 60 has a canopy 63 that transmits visible light while moving so as to simulate a candle flame. The canopy 63 may be flexible and change shape to simulate a flickering candle flame. The canopy 63 may move and/or change shape in response to movement of a rod within the canopy, the rod being actuated by an electric, magnetic or piezoelectric actuator, not shown in this figure. Operably coupled to the glowing canopy 63 is a light source 65, which emits electromagnetic radiation such as visible, infrared or ultraviolet light. In one embodiment the light source 65 is a LED or group of LEDs and the canopy 63 is translucent, and may transmit, diffuse, reflect and/or refract the radiation from the LED(s). The glowing canopy 63 may also include fluorescent or phosphorescent material that absorbs at least some of the radiation from the light source 65 and thereupon emits visible light.

The illumination device 60 includes a generally cylindrical shaft 66 that is designed to look like a paraffin wax body of a candle. The shaft 66 is held by what appears to be a candle holder 68, with a flange 70 provided to appear to catch candle wax that drips from the shaft 66. A tubular arm 77 is coupled to the candle holder 66 and flange 70, the arm held to a wall 73 by an attachment apparatus 76. A conduit or plurality of conduits, not shown, runs between the attachment apparatus 76 and the candle shaft 68 to carry electricity. A power supply 78 and optional electronics such as an AC/DC converter or voltage divider may be disposed on either side of the wall 73. Alternatively, the shaft may contain a power supply such as a battery.

Although a chandelier and wall sconce have been explicitly illustrated in the previous figures, other embodiments of illumination devices can alternatively be employed, such as candelabras, Christmas tree lights, lamps, etc.

Figure 3:
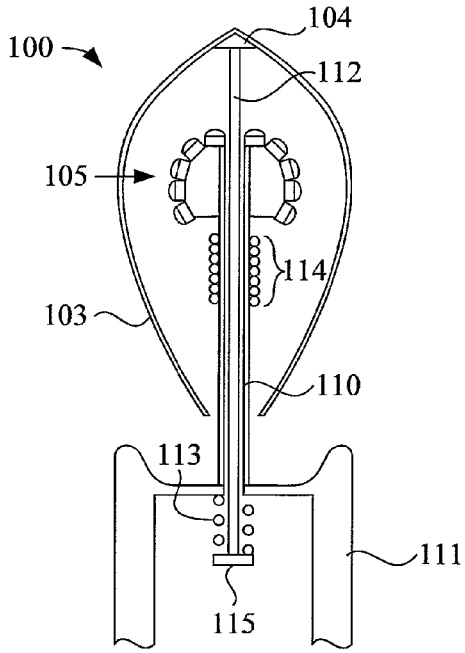
FIG. 3 is a schematic view of an embodiment of an illumination device that includes a flexible glowing canopy that substantially surrounds a light source such as a LED.

FIG. 3 shows a cross-sectional view of an embodiment of an illumination device 100 that includes a glowing canopy 103 that substantially surrounds a light source such as a plurality of LEDs 105. The LEDs 105 are disposed near a top of a pole 110 and held on a substantially semispherical substrate that is attached to the pole so that the LEDs can shine light in many directions. Only a cross-section of the LEDs are shown, so that LEDs directed toward and away from the viewer and in other angles are not shown. The LEDs 105 illuminate the canopy 103, which is shaped like the surface of a candle flame and may include or be coated with fluorescent or colored materials to produce a bright glow that simulates a candle flame when irradiated by the LEDs. Such fluorescent or colored materials, which may cloud the upper portion of the canopy 103 so that individual LEDs are not clearly visible from outside the canopy, may gradually diminish in, density toward the bottom of the canopy so that the canopy may be transparent at its extreme bottom.

The canopy 103 may have an opening at the bottom that the pole 110 extends through, and the canopy can move up and down when a rod 112 that is attached to an upper point of the shroud is actuated. A solenoid 114 that is wound around the pole 110 carries electrical current to produce a magnetic field to actuate the rod 112, which may be magnetized or have a magnetized portion. The solenoid 114 may move the rod 112 up and down in an erratic motion, which moves the canopy 103 up and down to simulate the flickering of a candle flame. The canopy 103 may be flexible so that it changes shape as the rod 112 moves up and down, with changing momentum of the canopy and the air inside the canopy affecting the canopy's shape. For example, the canopy 103 may undulate in response to the rod's motion when a tip 104 of the rod is attached to the canopy 103. Alternatively, the tip 104 may not be attached to the canopy 103 so that a ceiling of the canopy either rests on the tip, floats down to the tip when the tip is below the ceiling, or is jabbed by the tip when the tip moves upward, creating the illusion of a flickering flame. At least the tip 104 of the rod 112 may be translucent, the tip attached to an uppermost part of an inner surface of the canopy 103. In one embodiment most if not all of the rod 112 that extends from pole 110 is transparent. In one embodiment the tip 104 of the rod 112 may include a LED that is in constant or intermittent contact with the canopy 103. In one embodiment the rod 112 serves as an, optical fiber that carries light from a LED disposed near a bottom of the rod to be emitted at the tip 104. The light emitted from the tip 104 can be a different color than that of the other LEDs 105.

The canopy 103 may include woven material that is natural or synthetic, such as silk or cotton, nylon or rayon, or may be made of a solid or perforated sheet, for example a thin layer or film of plastic. Woven material can diffuse the light from the canopy and soften the edges of the canopy to look more like a flame that does not have a distinct border. The canopy 103 may include colored or fluorescent material, and such material may be painted (e.g., sprayed) onto the woven, perforated or solid sheet, on an interior and/or exterior surface of the canopy. Fluorescent paint is commercially available from many sources; for example, see www.krylon.com. To simulate a candle flame, the canopy 103 may be teardrop shaped and have a height of about ten centimeters or less.

In one embodiment, the canopy 103 can be stained with a fluorescent yellow material that absorbs and reradiates yellow and higher frequencies of light, and LEDs 105 can emit white light that makes the canopy glow yellow while the LEDs 105 appear to an outside observer to be red or orange, because those lower frequency colors are not absorbed by the canopy. Similarly, with canopy 103 including a fluorescent yellow material that absorbs and reradiates yellow and higher frequencies of light, LEDs 105 can emit a spectrum of light having a peak intensity of yellow, which makes the canopy glow yellow while the LEDs 105 appear to be orange, a color which is not absorbed by the canopy.

At least a bottom portion of the pole 110 is designed to look like a candle wick, with the wick attached to a shaft 111 that has the waxy, slightly translucent appearance of a candle body. For example, the pole 110 can be wrapped with a woven material such as cloth to simulate a candle wick, and the shaft 111 can be made of a cloudy but translucent plastic that has a polished-finish or is coated with wax. The pole 110 may be partly visible through a bottom portion of the canopy 103, with an upper portion of the pole and the protruding rod 112 hidden by an upper portion of the glowing canopy 103. The solenoid 114 or another portion of the pole 110 can be coated with red fluorescent paint to simulate the glow of a candle wick. In one embodiment, LEDs that emit red light can be attached to the pole below other LEDs that emit yellow or higher frequency light, the red LEDs simulating a glowing wick. Alternatively, the solenoid 114 can be coated black, with the winding simulating the texture of a woven wick, especially for the situation in which the solenoid is positioned near the bottom of the pole 110.

A spring 113 or other mechanism may limit the motion of the rod 112 to a desired range for giving the canopy 103 the appearance of flickering. For example the rod 112 may extend through an upper wall of the shaft 111 and have a flange 115 that catches on that wall to limit upward movement of the rod. In the embodiment shown in FIG. 3, the spring 113 is attached to both the upper wall of the shaft 111 and the flange limiting both upward and downward motion. In one embodiment, a bottom portion of the canopy 103 may be able to move sideways to the extent allowed by the gap between the pole 110 and the opening at the bottom of the canopy, depending upon the spring force of the canopy, tip 104 and rod 112 that opposes that motion. Alternatively, the bottom of the canopy 103 can be attached to the upper wall of the shaft 111, so that as the rod 112 moves up and down the canopy 103 expands and contracts in a vertical dimension, and contracts and expands in a horizontal dimension, respectively.

The LEDs 105 may be supplied with DC current of an appropriate voltage (typically 2-3V per LED) for example by connecting an appropriate number of the LEDs in series to divide the supply voltage into the correct amount per LED. A plurality of such groups of LEDs may run in parallel off the power supply. The solenoid 114 may be separately connected to the power supply, and controlled by a circuit such as a flicker circuit that varies the current so as to cause the rod 112, and therefore the canopy 103, to move. An oscillator or a plurality of such oscillators can be used to provide such a flicker circuit, as disclosed for example in U.S. Pat. No. 5,097,180, the teachings of which are incorporated by reference herein.

The LEDs 105 may instead be supplied with household AC power (typically 110V or 220V), which may be rectified by a full-wave bridge rectifier, and smoothed by appropriate capacitor(s) and/or inductor(s). Without such smoothing the LEDs 105 may flicker at the AC frequency of 60 Hz, which may be near the maximum frequency that is noticeable to people, and the phosphorescence, fluorescence or cloudiness of the shroud 103 may make that flicker imperceptible. Although the household voltage would destroy any individual LED, with an appropriate number of LEDs 105 connected in series can instead be used to power the LEDs. For example, 110V divided by 48 LEDs yields about 2.3V peak voltage per LED. A resistor can also be added to lower the voltage to an appropriate level for the desired number of LEDs 105. Because the LEDs 105 essentially do not conduct in the reverse direction unless a large breakdown voltage is exceeded, such a series of LEDs can rectify the 110V AC current, and two such series can form a full-wave bridge rectifier.

An appropriate inductor and/or capacitor can be connected in series with the LEDs 105 to smooth the voltage and current, reducing 60 Hz flicker and maintaining the voltage in an operating range suitable for each LED. The impedance of any inductors or resistors must be considered when calculating the number of LEDs 105 connected in series with the solenoid to achieve an appropriate voltage (typically 2-3V per LED). In one embodiment the solenoid 114 used for actuation can be connected in series with the LEDs 105, so that changes in the shape or position of the canopy 103 are accompanied by changes in the intensity of the light from the LEDs. For example, the solenoid 114 and rod 112 can be arranged so that the LEDs 105 are brighter when the rod is higher, accentuating the movement of the canopy 103 with the changing intensity of the LEDs, making the overall flicker effect more pronounced. With an appropriate selection of the values for the solenoid 114, LEDs 105, and spring force resisting motion of the canopy 103, the illumination device 100 may be made to flicker a desired amount due to a flicker circuit such as one or more oscillators operating in a frequency range between about 1 Hz and 20 Hz.

Figure 4:
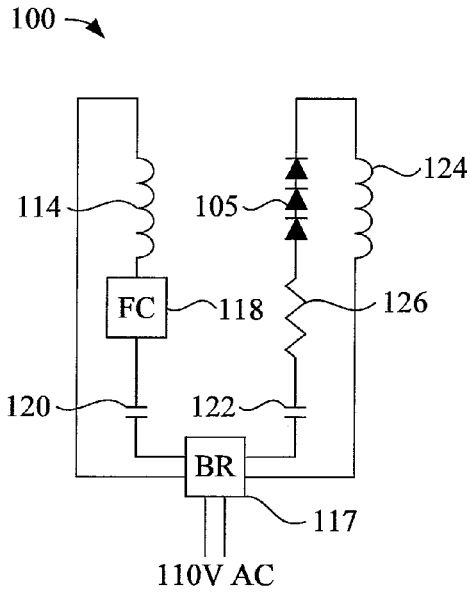
FIG. 4 schematic view of an embodiment of some electronics that may be included in the illumination device of FIG. 3.

FIG. 4 shows a circuit diagram for the illumination device 100, including a full-wave bridge rectifier 117 connected to AC voltage of about 110 V. A capacitor 120 may be in series with a flicker circuit 118 that varies the current in solenoid 114 to provide a pseudo-random actuation of rod 112. Also connected to the bridge rectifier 117 is a circuit driving LEDs 105, which may include a capacitor 122, an inductor 124 and a resistor 126 to provide a DC-like voltage in the range necessary to power each of the LEDs. Essentially all of the above-mentioned electronic components, with the exception of LEDs 105, may be disposed within the shaft 111 and hidden from view.

Figure 5:
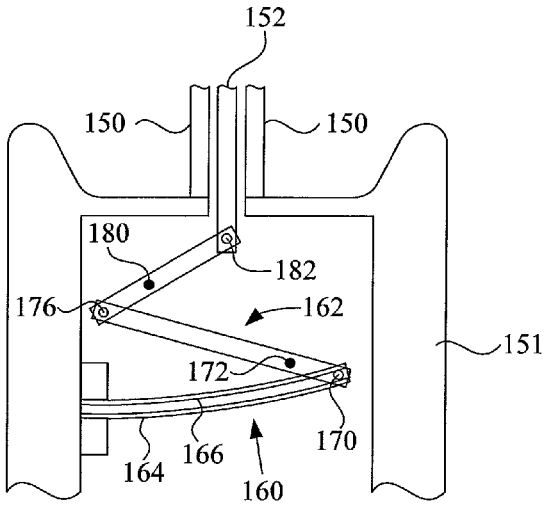
FIG. 5 is a cross-sectional view of an embodiment of a piezoelectric actuator for an illumination device similar to that shown in FIGS. 1-3.

FIG. 5 shows a magnified cross-section of piezoelectric actuator for an illumination device similar to that shown in FIGS. 1-3. A shaft 151 designed to look like a candle shaft supports a pole 150 through which a rod 152 extends to actuate an illuminated canopy, not shown in this figure. A piezoelectric bimorph 160 is connected to the rod 152 by a lever mechanism 162 that magnifies the movement of the bimorph. The bimorph 160 has piezoelectric (sometimes called piezorestrictive) layers 164 and 166 that can expand and contract relative to each other under application of a voltage, causing a tip of the cantilevered bimorph to move up or down. A first hinge pin 170 is coupled to the bimorph near its tip, the hinge pin also coupled to the lever 162. A first fulcrum pin 172 is attached to the shaft so that a first lever arm pivots about the first fulcrum pin, magnifying the motion at an end of the first lever arm distal to the first hinge pin 170. A second hinge pin 176 is coupled to the first lever arm and to a second lever arm, which pivots about a second fulcrum pin 180 that is attached to the shaft 151. The upward or downward motion at the second hinge pin 176 is magnified by the second lever arm, so that a third hinge pin 182 can move significantly up or down. The third hinge pin 182 is coupled to the rod 152, which moves up and down in a magnified fashion compared to the movement of the cantilever 160 tip.

Although a particular example of a piezoelectric actuator and lever mechanism is shown, other types of actuators and optional translation mechanisms may alternatively be employed. For example, an electrostatic actuator in which a distance between two plates is controlled by varying a voltage between the plates may be used to flutter a glowing canopy.

Figure 6:
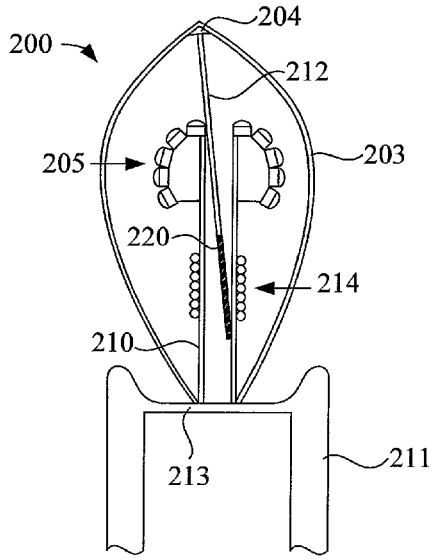
FIG. 6 is a cross-sectional view of an embodiment of an illumination device that includes a flexible glowing canopy that substantially surrounds a light source such as a plurality of LEDs and is attached to a simulated candle wick or shaft.

FIG. 6 shows a cross-sectional view of an embodiment of an illumination device 200 that includes a glowing canopy 203 that substantially surrounds a light source such as a plurality of LEDs 205. The LEDs 205 are disposed near a top of a pole 210 and held on a substantially semispherical substrate that is attached to the pole so that the LEDs can shine light in many directions. Only a cross-section of the LEDs 205 are shown, so that LEDs directed toward and away from the viewer and in other angles are not shown. The LEDs 205 illuminate the canopy 203, which is shaped like the surface of a candle flame and may include or be coated with fluorescent or colored materials to produce a bright glow that simulates a candle flame when irradiated by the LEDs. Such fluorescent or colored materials, which may cloud the upper portion of the canopy 203 so that individual LEDs are not clearly visible from outside the canopy, may gradually diminish in density toward the bottom of the canopy so that the canopy may be transparent at its extreme bottom. Alternatively or in addition, the canopy may gradually change color so that it is more blue near its bottom and yellow near its top.

The pole 210 is attached to an upper wall 213 of a shaft 211 that resembles a cylinder of wax for a candle. The canopy 203 in one embodiment may be attached to the pole 210 or to the wall 213 near a location at which the pole 210 is attached to the wall 213. The canopy 203 may become taller and thinner when the pole 210 moves upward, and shorter and wider as the pole, moves downward, changing shape to simulate a flickering candle flame. The canopy 203 may be vaporous, so that its movements resemble the airy fluttering of a candle flame. The canopy 203 may include more than one vaporous layer, which may extend the same or a different length down from the tip 204.

The pole 210 in one embodiment may have a significantly larger diameter than that of the rod 212, which when combined with the limited distance that the rod extends into the pole allows the rod to be either in or out of alignment with the pole. In general, a ratio of inner pole 210 diameter to outer rod 212 diameter of at least 2:1 can produce substantial sideways movement, with the upper limit governed by the rule that the rod should be more parallel than perpendicular to the pole. A magnetized portion 220 of the rod 212, which may as one example be a magnetic coating on a rod that is otherwise translucent, may experience a torque due to the magnetic field of the solenoid, which encourages the rod to be skewed relative to the pole 210. As the rod 212 moves up and down due to the changing field of the solenoid, its tip 204 may move from one side to another relative to the axis of the pole 210. For example, the momentum of the rod 212 as it moves downward may be opposite to the torque that the magnetized section 220 felt when the rod previously moved upward, so that the tip 204 swings to another position on the next trip upward. The pseudo-random sideways motion of the tip 204 can add to the simulation of flickering by the canopy 203. The tip 204 may or may not be attached to the canopy 203. The rod 212 may be supported by the wall 213 when the solenoid is off, and may or may not bounce off the wall when the solenoid is on. Optionally, a spring or similar device may be attached to the rod 212 and/or the wall 213 to affect the rod's motion. The ability of the glowing canopy 203 to move up down, sideways and to change shape can provide a realistic simulation of a candle flame.

Figure 7:
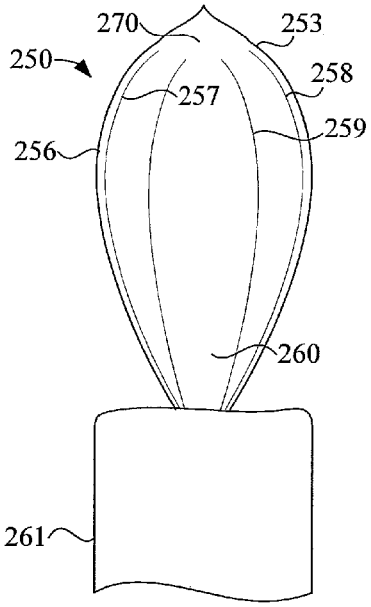
FIG. 7 is a side view of an embodiment of an illumination device that includes a flame-shaped glowing canopy that may be formed of a single piece of material that includes a plurality of sections.

FIG. 7 is a side view of an embodiment of an illumination device 250 that includes a flame-shaped glowing canopy 253 that is formed of a piece of material that includes a plurality of sections 256, 257, 258 and 259 that together substantially surround a light source such as a LED. In this example, the LEDs are hidden from view within the glowing and fluttering canopy 253. The LEDs may alternatively be located on an upper wall of the shaft 261 with their light directed upward onto the canopy 253. In that case, a moveable rod may extend through the upper wall of the shaft, propelled by an inductive, piezoelectric or other actuator. The sections 256, 257, 258 and 259 may be made of a woven, solid or perforated material, and each of the sections may be contiguously attached to an adjacent section or adjacent sections may be separated from each other but connected at the top end of the canopy 253. The separated sections 256, 257, 258 and 259 may overlap each other during operation, and the sections may be joined together in an upper region 270.

Figure 8:
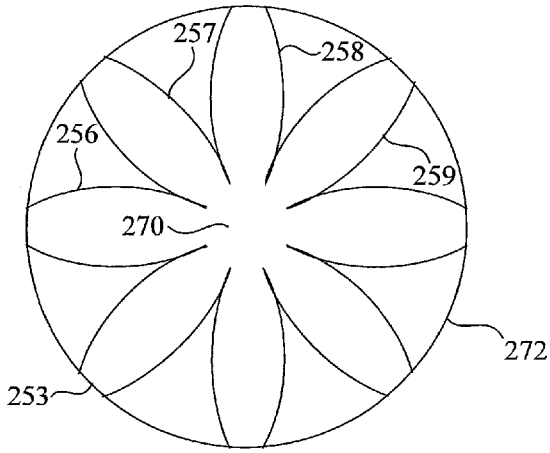
FIG. 8 is a top view of an embodiment of the canopy shown in operation in FIG. 7, which may be made from a single piece of material.

As shown in FIG. 8, in one embodiment the sections 256, 257, 258 and 259 of the canopy 253 shown in operation in FIG. 7 may be joined together in region 270 because they are all cut from a single piece of material 272. Although eight sections are shown, more or less are possible. The sections 256, 257, 258 and 259 may be the same or different colors. It is also possible to have one or more other glowing canopies nested within canopy 253, with the sections of the nested canopy preferably offset from the sections of canopy 253. As before, the canopy 253 may transmit, diffuse, reflect and/or refract the radiation from the LEDs, and may for example be painted (e.g., sprayed) with fluorescent paint. The material forming the canopy 253 may have a shape of a flower, with petals corresponding to sections 256, 257, 258 and 259. Although embodiments of canopies may be formed in sections as described above, alternatively such canopies may be woven in a desired shape or created on molds of the desired shape that are then removed.

Figure 9:
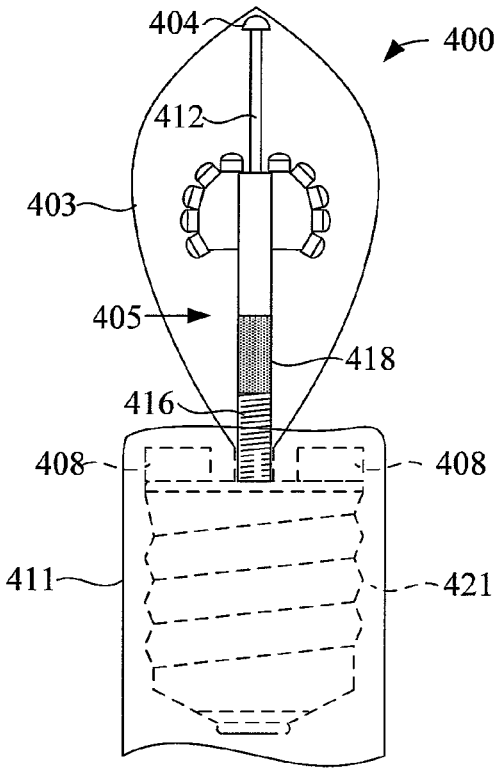
FIG. 9 is a side view of an embodiment of an illumination device with a standard fitting such as an Edison Screw that allows the illumination device to serve as an easily implemented replacement for incandesdent light bulbs.

FIG. 9 is a side view of an embodiment of an illumination device 400 that includes a flexible glowing canopy 403 that is operationally coupled to a light source such as a LED 405 held by a pole 410 designed to look like a candle wick. The illumination device 400 in, this embodiment includes a conductive threaded base portion 421 that is designed to screw into a conductive threaded socket in the shaft 411. The base portion 421 and the socket may both correspond to a standard fitting size such as an "Edison Screw" E10, E11, E12, E14, E17, E25, E26, E27, E29, E39 or E40. Alternatively, such an illumination device can be made with a standard two-pronged "Bayonet Cap" fitting, such as BC or B22. Providing an illumination device with such standard fittings allows the illumination device to serve as an easily implemented replacement for common incandescent light bulbs.

Similar to an embodiment disclosed above, the "wick" 410 is attached to a generally cylindrical shaft 411 that is designed to look like a wax body of a candle. Encircling the pole 410 adjacent to the shaft 411 is a conductive coil or solenoid 416, which can be used to move the canopy 403, and which is colored black in this embodiment to simulate a burnt portion of a candle wick. Above the solenoid 416, a section 418 of the pole 410 has been coated with fluorescent or phosphorescent paint that glows red in response to light from the LED 405, like a glowing portion of a candle wick. The canopy 403 includes yellow fluorescent or phosphorescent that fades in strength in the region of the glowing portion 418 of the "wick," so that the bottom portion of the canopy is translucent but tinged blue. A magnetized pole 412 is activated by the solenoid 416 to move up and down, so that a translucent tip 404 of the pole jabs at the canopy 403 to make it flutter. material that has been magnetized so that it is attracted to or repulsed by the coil 416, depending upon the direction of electric current in the coil.

The base 421 may have an electrically insulating upper surface that is recessed compared to an upper edge of the shaft 411 in one embodiment. Although the coil 416 is shown as extending above the upper edge of the shaft 411, the coil may instead also be recessed compared to that upper edge. Alternatively, the coil 416 may, continue further up the pole 410, and may encircle the entire pole. Two radially aligned fins 408 are provided in one embodiment as an aid for screwing the base portion 421 into and out of the socket.

Figure 10:
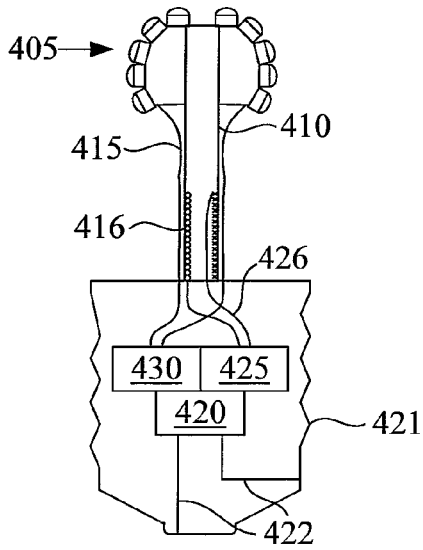
FIG. 10 is a schematic view of an embodiment of a part of the illumination device of FIG. 9.

FIG. 10 is a schematic view of part of the illumination device 400 of FIG. 9. A first pair of electrical leads 422 are connected between the threaded base 421 and a first electronic circuit 420, the leads 422 designed to receive household AC of either approximately 115 V or 230 V. The first electronic circuit 420 may include an AC/DC converter that provides an appropriate voltage level of substantially direct current that is separately provided to the LED 405 and to the solenoid 416, or the LED and solenoid may be connected in series. First electronic circuit 420 may also include a voltage divider for the situation in which the voltage between leads 422 is too high for use by LED 405 or solenoid 416. In addition, first electronic circuit 420 may include a flicker circuit that varies the voltage and/or current provided to solenoid 416 and/or LED 405, in an attempt to simulate the appearance of a flickering candle flame.

Many such mechanisms can be found in the myriad patents and applications that attempt to teach how to simulate a candle flame, although those mechanisms may be primarily directed to changing the intensity of an electrically powered light rather than changing the shape of a gossamer canopy. For example, U.S. Pat. Nos. 4,492,896, 4,510,556, 4,593,232, and 5,097,180, the teachings of which are incorporated by reference herein, disclose mechanisms that would be known to one of ordinary skill in the art.

A second electronic circuit 425 is connected between the first electronic circuit 420 and leads 426 for the solenoid 416. The second electronic circuit 425 may contain a voltage divider to lower the voltage provided to solenoid 416, and may also include a rectifier or diode. Second electronic circuit 425 may also contain a mechanism that varies the voltage and/or current provided to solenoid 416, actuating the pole 412 and causing the canopy 403 to flutter like a flickering candle flame.

A third electronic circuit 430 is connected between the first electronic circuit 420 and leads 415 for the LED 405. The third electronic circuit 430 may contain a voltage divider to lower the voltage provided to LED 405, and may also include a rectifier or diode. Third electronic circuit 430 may also contain a mechanism that varies the voltage and/or current provided to LED 405, in an attempt to simulate the appearance of a flickering candle flame.

Alternatively, electronics similar or equivalent to that described for first, second and third electronic circuits may be disposed in a location remote from the LED 405 and/or solenoid 416. For example, a chandelier that has electrical wiring for incandescent light bulbs can be fitted with an adapter that converts single or two phase alternating current (e.g., 110V or 220V) to direct current of 5V, 12V or another amount designed to power the LED 405 and the solenoid 416. Such an adapter can be disposed, for instance, in the body 40 or mounting apparatus 46 of the chandelier 30 shown in FIG. 1. Because the wiring in this case has been over-engineered to handle much higher voltage and current than the single or double digit DC voltage output by the adapter, little resistance and corresponding voltage and current drop would be expected at the LED 405 compared to the adapter. For the situation in which the LED 405 is designed to run on a different voltage or current than the solenoid 416, appropriate voltage and current dividers can be provided in the first, second or third electronic circuits to convert the electrical power as needed.

The foregoing description of the embodiments of the invention has been presented for the purposes of illustration and description. It is not intended to be exhaustive or to limit the invention to the precise form disclosed. For example, although an LED is disclosed other sources of electromagnetic radiation may instead be used Many modifications and variations are possible in light of the above teaching. It is intended that the scope of the invention be limited not by this detailed description, but rather by the claims appended hereto.

Any advantages and benefits described may not apply to all embodiments of the invention. When the word "means" is recited in a claim element, applicant intends for the claim element to fall under 35 USC section 112, paragraph 6. A label of one or more words may precede the word "means", which is intended to ease referencing of claims elements and is not intended to convey a structural limitation. Such means-plus-function claims are intended to cover not only the structures described herein performing the function and their structural equivalents, but also equivalent structures. For example, although a nail and a screw have different structures, they are equivalent structures since they both perform the function of fastening. Claims that do not use the word means are not intended to fall 35 USC section 112, paragraph 6.

The invention claimed is:

1. An illumination device comprising:

a light source including a light emitting diode (LED) that emits electromagnetic radiation;

a canopy that substantially encircles the light source and simulates a candle flame when irradiated by the light source; and an actuator including a rod that is operably coupled to an upper portion of the canopy to move the canopy.

2. The device of claim 1, wherein the actuator includes a solenoid and at least a portion of the rod is magnetized to react to the solenoid.

3. The device of claim 1, wherein the actuator includes a piezoelectric material that is coupled to the rod.

4. The device of claim 1, wherein the canopy includes a fluorescent or phosphorescent material.

5. The device of claim 1, further comprising a threaded conductive portion that fits in an electrical socket and is electrically coupled to the light source and the actuator.

6. The device of claim 1, wherein the rod has a translucent tip that contacts the canopy.

7. The device of claim 1, wherein the actuator can move the canopy up and down.

8. The device of claim 7, wherein the actuator can move the canopy sideways.

9. The device of claim 1, wherein the canopy is flexible and the actuator can change the shape of the canopy.

10. An illumination device comprising:

a light source including a light-emitting diode (LED) that emits electromagnetic radiation;

a canopy disposed adjacent to the light source to receive the radiation and consequently transmit visible light from the canopy;

an actuator that is operably coupled to the canopy, the actuator having at least one winding that curves around an axis, the winding having a winding portion disposed at a radius from the axis; and a rod that is oriented more parallel than perpendicular to the axis and disposed at a distance from the axis that is less than the radius, at least a portion of the rod being magnetized, the rod being operably coupled to the canopy to move the canopy when a current in the winding induces a magnetic field in the solenoid.

11. The device of claim 10, wherein the canopy is flexible and changes shape in response to movement of the rod.

12. The device of claim 10, wherein the canopy includes a fluorescent material.

13. The device of claim 10, wherein the rod is made of magnetic material.

14. The device of claim 10, wherein the rod is made of translucent material.

15. The device of claim 10, wherein the rod has a translucent tip that impinges on the canopy.

16. The device of claim 10, wherein the canopy at least partly surrounds the light source.

17. The device of claim 10, wherein the canopy is shaped as a candle flame.

18. The device of claim 10, further comprising a pole that is attached to the solenoid and is substantially aligned with the axis.

19. The device of claim 18, wherein the pole simulates a candle wick.

20. The device of claim 10, further comprising a threaded conductive portion that fits in an electrical socket and is electrically coupled to the solenoid.

21. A method for illumination comprising:

providing a flexible canopy that is operably coupled to a light source;

emitting electromagnetic radiation from the light source such that the radiation impinges upon an interior surface of the canopy;

transmitting, by the canopy, visible light in response to receiving the radiation from the light source; and moving the canopy with a rod that contacts an upper portion of the canopy during the transmitting.

22. The device of claim 21, wherein moving the canopy includes changing the shape of the canopy.

23. The method of claim 22, wherein impinging an upper portion of the canopy with a rod includes actuating the rod with a solenoid.

24. The method of claim 22, wherein impinging an upper portion of the canopy with a rod includes actuating the rod with a piezoelectric actuator.

25. The method of claim 21, wherein the transmitting visible light includes fluorescing.

26. The method of claim 21, wherein emitting electromagnetic radiation from the light source includes passing at least some of the radiation through the canopy as the visible light.

27. The method of claim 21, wherein emitting electromagnetic radiation from the light source includes flowing current through a light-emitting diode (LED).

28. The method of claim 21, wherein providing the flexible canopy that is operably coupled to the light source includes providing a pole that simulates a candle wick, and emitting electromagnetic radiation from the light source includes emitting light from the pole to simulate a glowing portion of the wick.

* * * * *